United States Patent [19]

Eheim et al.

[11] 4,364,360

[45] Dec. 21, 1982

[54] FUEL INJECTION SYSTEM FUNCTIONING WITH PUMP/NOZZLES

[75] Inventors: Franz Eheim, Stuttgart; Gerald Höfer, Weissach-Flacht, both of Fed. Rep. of Germany

[73] Assignee: Robert Bosch GmbH, Stuttgart, Fed. Rep. of Germany

[21] Appl. No.: 225,165

[22] Filed: Jan. 15, 1981

[30] Foreign Application Priority Data

Jan. 15, 1980 [DE] Fed. Rep. of Germany ..... 3001154

[51] Int. Cl.[3] ..... F02M 41/00

[52] U.S. Cl. ..... 123/450; 123/458; 123/459; 123/501

[58] Field of Search ..... 123/450, 459, 458, 501, 123/499

[56] References Cited

U.S. PATENT DOCUMENTS

| | | | |
|---|---|---|---|
| 3,837,324 | 9/1974 | Links | 123/458 |
| 3,851,635 | 12/1974 | Murtin et al. | 123/459 |
| 3,921,604 | 11/1975 | Links | 123/499 |
| 3,951,117 | 4/1976 | Perr | 123/450 |
| 4,092,964 | 6/1978 | Hofer et al. | 123/459 |
| 4,241,714 | 12/1980 | Knape et al. | 123/499 |
| 4,280,464 | 7/1981 | Kanai et al. | 123/499 |

FOREIGN PATENT DOCUMENTS

| | | | |
|---|---|---|---|
| 689706 | 4/1953 | United Kingdom | 123/450 |

*Primary Examiner*—Charles J. Myhre
*Assistant Examiner*—Magdalen Moy
*Attorney, Agent, or Firm*—Edwin E. Greigg

[57] ABSTRACT

A fuel injection system is proposed which functions with pump/nozzles, in which a control slide which determines the injection onset and disposed in each pump/nozzle is triggered by a distributor unit and the variation of the injection onset is effected by rotation of an annular slide which surrounds the distributor.

10 Claims, 3 Drawing Figures

FUEL INJECTION SYSTEM FUNCTIONING WITH PUMP/NOZZLES

BACKGROUND OF THE INVENTION

The invention is based on a fuel injection system functioning with pump/nozzles. In a known fuel injection system of this kind, the injection onset is controlled by way of an electromagnetically actuated valve, which controls a flow of fuel to actuate a switchover valve, which in turn determines the stroke onset and thus the injection onset of the pump piston. This type of injection onset adjustment does have the advantage that it is electrically triggerable, but because of the hydraulic volume it encloses and because of the hydraulic sequence control, it is relatively imprecise; and because of the structural components and the embodiment thereof, it is quite expensive.

OBJECT AND SUMMARY OF THE INVENTION

The fuel injection system according to the invention has the advantage over the prior art that it provides a simple and very precise means of controlling the injection onset. The groove control means which is used has proved in practice to be extremely precise, at a relatively low cost of manufacture. In addition, it is possible to use parts made in the mass production of distributor pumps. Further advantageous embodiments of the invention are shown in the drawing and are described in detail below.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
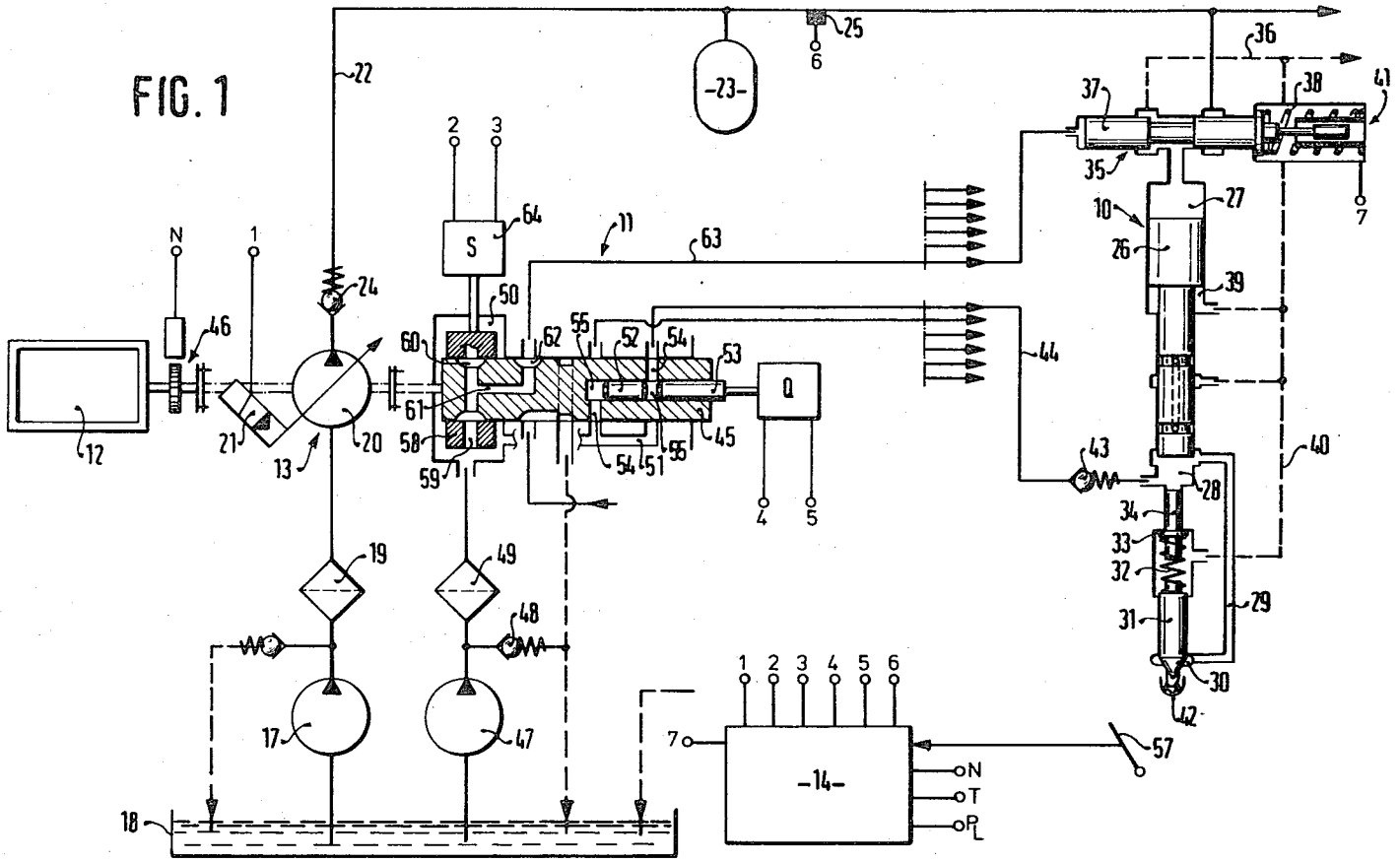
FIG. 1 is a simplified representation of the first exemplary embodiment.

In FIG. 1, a fuel injection system is shown for a six-cylinder engine. However, only one pump/nozzle 10 is shown, which is opened under the control of a metering and distributor unit 11 also controlling the other five pump/nozzles. While the metering and distributor unit 11 operates at an average fuel pressure, a pump system 13 also driven, like the metering and distributor unit 11, by the internal combustion engine 12 generates the high pressure for a servo fluid, which again is preferably fuel. The fuel injection system is regulated with the aid of an electronic control device 14, in which actual-value signals picked up at various points, as described below, are processed and appropriate set-point signals are fed via converters to the appropriate control elements of the injection system.

The high-pressure pump system 13 operates with two pumps disposed one after the other; the first is a prepump 17, which aspirates the fuel out of a container 18 and supplies it via a filter 19 to the second, which is a servopump 20 acting as the high-pressure pump. An electrical zero-stroke control element or pressure maintenance valve serves to maintain sufficient pre-supply pressure. The pressure or the supply output of the servopump 20 can be varied via a magnetic control element 21. The magnetic control element 21, as a converter, receives the appropriate control signal from the electronic control device 14 via the terminal 1. A pressure line 22 leads from the servopump 20 to the individual pump/nozzles, which are all supplied with servo fluid, generally fuel, from this high-pressure line 22. A pressure reservoir 23 is connected to the pressure line 22 in order to maintain a substantially constant pressure at the nozzles. The pressure line 22 is coupled with the servopump 20 by way of a check valve 24. The pressure in the line 22 is measured by a transducer 25 and then fed to the electronic control device 14 via the connection terminals 6. Then, either the electronic control device 14 effects a correction of the supply pressure of the pump via the magnetic control element 21, if changes have been ascertained by the pressure transducer 25, or else this correction causes a change in the high pressure in accordance with other engine characteristics which have been fed into the electronic control device 14.

The pump/nozzles 10, only one of which is shown, operate with a servopiston 26. The servopiston 26 is embodied as a stepped piston (or it is made up of two pistons having different diameters), the larger face of which defines a servopressure chamber 27 and the smaller face of which defines the pump work chamber 28. A pressure line 29 leads from the pump work chamber 28 to the pressure chamber 30 of the nozzle. The nozzle operates with a nozzle needle 31, which is urged in the closing direction by a closing spring 32. The closing spring 32 is supported, on its side remote from the nozzle needle 31, on a shoulder 33 of a closing piston 34, which protrudes with its end face remote from the nozzle needle into the pump work chamber 28.

Communication between the servopressure line 22 and the servopressure chamber 27 is controlled by means of a slide valve 35. This slide valve 35 is actuated in synchronism with the cycles of the engine 12 by the metering and distributor unit 11, and it thus alternatively connects the servopressure chamber 27 with either the pressure line 22 or a relief line 36. The slide valve 35 operates with a control slide 37, which is hydraulically driven and displaceable counter to a restoring spring 38. The chamber 39 formed by the step of the servopiston 26 and the chambers receiving the springs 32 and 38 all communicate via a leakage line 40 with the relief line 36. The position and/or the distance travelled by the control slide 37 is measured by a travel transducer 41 and fed via the terminals 7 into the electronic control device 14.

The described pump/nozzle functions as follows:

The pump work chamber 28 is supplied by the metering and distributor unit 11 with a metered quantity of fuel via a metering line 44 and a check valve 43. The servopiston 26 is displaced during this operation into the servochamber 27, thus forcing fuel out via the slide valve 35 into the relief line 36. Then as soon as the control slide 37 has been displaced counter to the spring 38 by the metering and distributor unit 11, the servopressure line 22 is connected with the servopressure chamber 27; this occurs either after or shortly before the servopressure chamber 27 is separated from the relief line 36. As a result, the servopiston or pump piston 26 is displaced into the pump work chamber 28, thus forcing fuel via the pressure line 29 into the pressure chamber 30. As soon as a sufficiently high pressure has been attained, the valve needle 31 is displaced counter to the spring 32, so that the fuel reaches the combustion chamber of the engine via injection ports 42. After a predetermined supply stroke of the pump piston 26, its lower end face blocks the outflow to the pressure line 29, so that the fuel pressure in the chamber 28 increases further, until the closing piston 34 is first pressed against the spring 32 and then directly against the nozzle needle 31. In the meantime the supply to the pressure chamber 30 via the pressure line 29 has been interrupted, resulting in a rapid and good-quality closure of the injection nozzle. Then as soon as the control slide 37 slides back into its outset position in which it is shown in the drawing, which occurs under the control of the metering and distributor unit 11, fuel can again be metered into the pump work chamber 28, whereupon the pump piston 26 is again displaced accordingly. A new injection procedure can now take place.

The metering and distributor unit 11 functions with a distributor 45, which is driven by the engine 12. The rpm of the distributor 45, and in the exemplary embodiment of the high-pressure pump 20 as well, is measured via an rpm transducer 26 and fed via the terminals N/N into the electronic control device 14. The distributor 45 has a twofold control function: first, it distributes a metered quantity of fuel to the various individual pump-/nozzles; and second, it determines the injection onset by actuating the control slides 37 (reversible valves). The distributor 45 receives fuel from a pump 47 which generates an average pressure. The supply pressure of this pump 47 is determined by a pressure control valve 48. A filter 49 is disposed between the pump 47 and the distributor unit 11. The fuel proceeds from the average-pressure pump 47 into a receptacle chamber 50 in the housing of the metering and distributor unit 11. From the receptacle chamber 50, the fuel then proceeds via a line 51 to the actual fuel metering apparatus. This fuel metering apparatus comprises a reciprocating metering piston 52, whose stroke is determined by a stop 53. The chambers 53 at either side of the metering piston 52 communicate via appropriate distributor bores 54 in the distributor 45 with the line 51 or the metering line 44 of the pump/nozzle in such a manner that one of the chambers 55 always communicates with the line 51 and the other of the chambers 55 communicates with the pump work chamber 28 and thus with the pump/nozzle. The metering piston 52 is displaced by the fuel flowing in via the line 51 and thus supplies fuel via the metering line 44 into the pump work chamber 28 until such time as the metering piston 52 strikes against the stop 53. The stop 53, in turn, is adjustable, so that the travel distance of which the metering piston 52 is capable determines the injection quantity. The initial points of the metering lines 44 and the point of discharge of the line 51 are distributed about the distributor 45 in such a fashion that the pump work chamber 28 of one pump nozzle after another is always being supplied with fuel, and this always takes place in alternation from one of the two metering chambers 55. The stop 53, in this exemplary embodiment, is adjusted by a servomotor Q, which receives its control signal via the terminal 4 from the electronic control device 14. At the same time, an actual-value transducer is available in the servomotor Q which furnishes the actual position of the stop 53 to the electronic control device 14 via the terminals 5. The fuel quantity to be injected is determined in the electronic control device 14 in accordance with various input variables. One of these input variables is the position of the gas pedal 57; another variable is the rpm, fed by the rpm transducer 46 via the terminal N. Other variables may be the temperature T or the air pressure $P_L$. In each case, there is a virtually optimal degree of freedom in the influence exerted upon the fuel injection quantity. Because the injection onset is determined in this case independently of the fuel metering, the distribution of the metered quantities to the individual nozzles can be made within fairly broad tolerances.

The second function of the distributor 45 is the control of the injection onset. To this end, an annular slide 58 is disposed about the distributor 45 in the vicinity of the receptacle chamber 50. This annular slide 58 has radial bores 59, which are opened during the rotation of the distributor 45 by longitudinal grooves 60 disposed in the jacket face of the distributor. A channel 61 disposed in the distributor 45 leads from the longitudinal grooves 60 to a longitudinal distributor groove 62 disposed in the jacket face of the distributor. This longitudinal distributor groove 62 opens up the discharge ends of control lines 63, which lead to the various pump/nozzles and then to the slide valves 35. The initial ends of the control lines 63 are correspondingly distributed about the circumference of the distributor 45, so that the slides 37 are actuatable one after another by means of the fuel flowing in from the receptacle chamber 50. The amount of overlap of the longitudinal groove 62 at the individual control lines 63 is relatively large, so that it is not necessary here to keep the precise tolerances. The opening up of the bores 59 by the longitudinal grooves 62, on the contrary, must be effected quite precisely, because this action determines the injection onset. Whenever the slide 37 of the pump/nozzle connects the pressure line 22 with the servopressure chamber 27, the injection begins. In order to be able to vary this injection onset, the annular slide 58 is rotatable on the distributor 45. As a result, the instant at which the longitudinal grooves 60 open the radial bores 59 is shifted relative to the rotary position of the drive shaft. The onset of injection—that is, the beginning of the actuation of the slide 37—is shifted accordingly. An injection time adjustment of this kind may be required for various reasons, in accordance with the rpm or in accordance with load, temperature, or other engine characteristics, for example. The rotation of the annular slide 58 is effected with the aid of a servomotor 64. This servomotor 64, as a converter, receives its actuation signal from the electronic control device 14 via the terminals 2. device 14 via the terminals 2. The actual position of the rotary slide 37 is fed to the electronic control device 14 as a transducer value via the terminals 3. In order to correct any errors which might be produced by the hydraulic actuation, the transducer value of the servomotor 64 is compared with the transducer value of the transducer 41 from the slide valve 35. Here, as well, it is possible to attain an optimum result in terms of fine adjustment and in terms of influencing the fuel injection quantity, especially in consideration of various engine characteristics.

As a result of the selected combination of electronic transducers, electric converters and mechanical control elements, it is possible to influence the performance of injection via engine characteristics, without there being disadvantageous secondary influence exerted by various control units, such as the metering apparatus and the injection onset apparatus.

Figure 2:
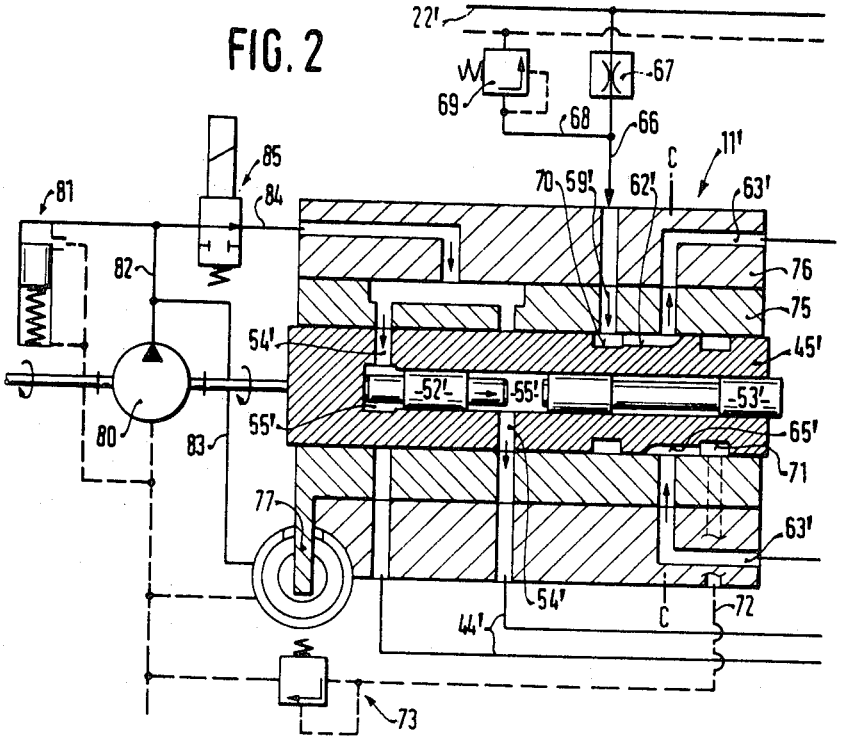
FIG. 2 is a simplified representation of the second exemplary embodiment.

In FIG. 2, a metering and distributor unit is shown which functions in principle like that shown in FIG. 1.

However, in contrast to the exemplary embodiment shown in FIG. 1, the fluid for controlling the injection onset is not drawn from the average-pressure pump for fuel; instead, it is taken from the high-pressure line 22' for the servofluid. The servofluid may, for example, be a more viscous oil acting as fuel, in order thereby to keep leakage amounts smaller; leakage is especially prevalent, of course, at high pressures. In order to arrive at an appropriate control pressure, a throttle 67 is inserted into the line 66 leading from the high-pressure line 22' to the distributor unit 11'. Downstream of this throttle 67, a control line 68 in which a pressure maintenance valve 69 is disposed branches off from the line 66. This manner of obtaining the control fluid for the injection onset is shown here purely by way of example. Naturally, in this exemplary embodiment shown in FIG. 2 as well, it is possible for fuel, or some other fluid supplied by an average-pressure pump, to be used as the control fluid.

The fuel then flows out of the line 66 via the radial bore 59' and reaches an annular groove 70 disposed in the jacket face of the distributor 45'. The longitudinal distributor groove 62' then branches off from this angular groove 70 and opens up the discharge ends, distributed about the circumference of the distributor 45', of the control lines 63' leading to the pump/nozzles 10' in order to actuate the control slide 37' disposed on the pump/nozzle 10'. The control lines 63' not connected to the distributor groove 62' may be relieved of pressure via longitudinal grooves 65', in order to enable a return stroke of the control slide 37' of the pump/nozzle 10'. The longitudinal groove 65' is likewise disposed in the jacket face of the distributor 45'. It discharges into an annular groove 71, which in turn communicates permanently with a leakage line 72. A pressure maintenance valve 73 is disposed in the leakage line 72 in order to maintain a minimum pressure in the control system for the injection onset, so that an overload of the control line is prevented from occurring.

Figure 3:
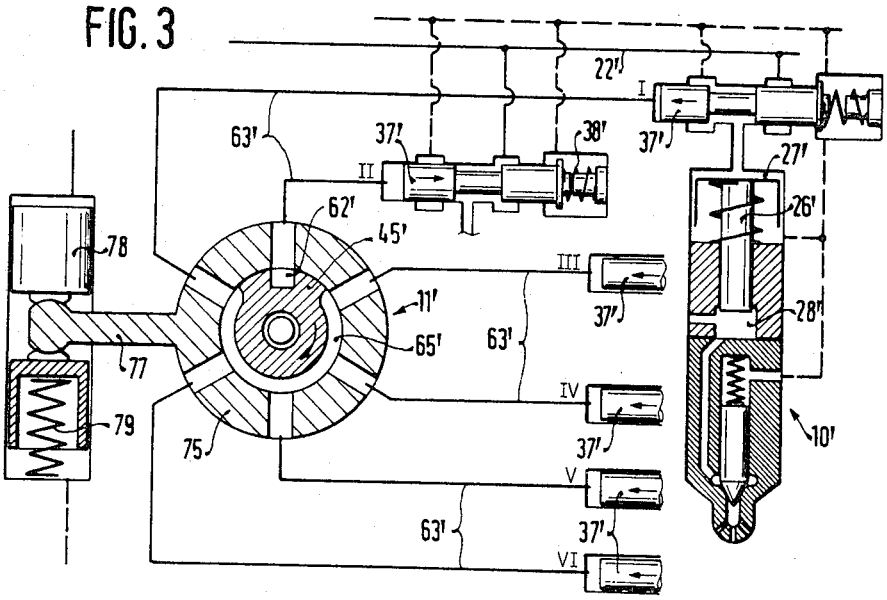
FIG. 3 is a view on line C—C of FIG. 1 and further showing the distributor connected to pump/nozzles.

In FIG. 3, a section is shown taken through the distributor along line C—C of FIG. 2. The pump/nozzles 10' opened by the distributor unit 11' are additionally numbered I–VI. While the control slides 37' of nozzles I, II, IV, V, and VI are shown as they execute their return stroke or have already assumed their outset position, the control slide 37' of the pump/nozzle II is moving counter to its restoring spring 38' and thus connects the pressure line 22' with the servopressure chamber 27' of the pump/nozzle. The pump/nozzle 10' or I shown in this drawing is shown in the outset position of the pump piston 26'. In accordance with the control position shown, the control line 63' of the pump/nozzle II communicates with the distributor groove 62'. The control lines 63' of pump/nozzles I and III, IV, V and VI, in contrast, communicate with the longitudinal relief groove 65'.

The distributor 45' is supported in a control sleeve 75, which is rotatably disposed in the housing 76 of the distributor unit 11'. When the control sleeve 75 is rotated, the instant at which the longitudinal distributor groove 62' opens the control line 63' is varied. Because it is intended to vary the injection onset primarily in accordance with rpm, a piston 78 engages one arm 77 of the control sleeve 75, the piston 78 being exposed on its side remote from the arm 77 to fluid whose pressure varies in accordance with the rpm. This variation of the instant of injection should be understood to depend on the rotary position of the engine shaft; that is, it depends on the position of the pistons of the engine. The higher the rpm, the earlier injection should occur, because there is correspondingly less time available for preparation of the fuel than at low rpm. For this reason, as the pressure of the fuel exerted on the piston 78 increases, the piston 78 is displaced downward in FIG. 3; this causes a corresponding variation in the injection onset toward "early", because the distributor groove 62' opens the control line 63' somewhat earlier. The displacement of the piston 78 is effected counter to the force of a restoring spring 79.

The rpm-dependent pressure of this injection onset adjustment apparatus is generated by a pump 80 (FIG. 2), which like the distributor 45' is driven by the engine. The supply pressure of the pump 80 is additionally controlled by a pressure control valve 81, so that it varies in proportion to the rpm. In addition to a line 83 leading to the injection adjustment apparatus, a line 84 branches off from the pressure line 82 of this pump 80 and leads to the metering unit of the pump/nozzles. This line 84 can be blocked by means of a magnetic valve 85. The metering unit housed in the distributor unit 11', in turn, functions with a metering piston 52' whose stroke is variable by means of a stop 53'. The radial bores 54' disposed in the distributor 45' cause the chambers at either side of the metering piston 52' to communicate alternatively with the line 84 or with one of the metering lines 44' leading to the pump/nozzles.

In accordance with the invention, the distributor may also execute a reciprocating movement and thus act at the same time as the pump piston. The pump supply quantity, regulated by known means, can then be stored up in advance in the pump/nozzles, so that the "distributor pump" acts as a metering pump. A rotary slide may be disposed about the piston of this distributor pump piston, as described above, and may have the corresponding control locations for controlling the injection onset slides 37. In accordance with the invention, in each case there is a rotary slide at least partially surrounding the distributor and having corresponding control locations between the distributor and the rotary slide from the control lines leading to the control slides 37; the rotation of the member slide determines the injection onset, or in other words the onset of the control movement of the slides 37.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for internal combustion engines comprising a plurality of pump/nozzles a high pressure servo fluid source, (a) each said pump/nozzle including a servo piston, said servo piston including a large diameter portion and a small diameter portion, a pump work chamber below said small diameter portion and a servo pressure chamber above said large diameter portion, said servo pressure chamber receiving via a servo pressure line servo fluid from said high pressure servo fluid source for driving said servo piston;

(b) a control fluid source, a, control apparatus for injection onset which controls the servo fluid from said servo fluid source to said servo pressure chamber for driving said servo piston in proportion to the stroke of the engine; said control apparatus including a hydraulically driven switchover valve, said switchover valve being driven by means of a control fluid delivered via a control line from said control fluid source, said switch-over valve being arranged in one switching position to direct said servo fluid from said high pressure servo fluid source to said servo pressure chamber above said servo piston and in another switching position is arranged to direct the servo fluid from said servo pressure chamber to a relief line, the instant of opening the servo pressure line leading from the high pressure servo fluid source to said servo pressure chamber of said pump nozzle is variable from a variation of the injection instant by said control apparatus;

(c) a distributor device serving to control said control fluid and having a rotating distributor provided with a jacket face and distributor grooves disposed in said jacket face by means of which said source of control fluid is connected and thereafter disconnected during one rotation in sequence with and from said control lines leading to said switch over valves of said pump/nozzle; a fuel metering apparatus arranged to determine the fuel quantity of the fuel to be injected and storing up said fuel into said pump work chamber below said pump piston, characterized in that the flow of said control fluid to said switchover valve is controlled by means of said distributor device via control locations disposed between said distributor and a rotatable annular slide which surrounds said distributor, whereby injection onset is varied by rotation of said annular slide by means of a servomotor, and wherein said fuel metering apparatus includes a supply volume controllable positive-displacement piston pump.

2. A fuel injection system as defined by claim 1, characterized in that said control and fuel metering apparatuses have only a single, common distributor as a structural unit for controlling said control fluid as well as the metered fuel to be injected.

3. A fuel injection system as defined by claim 2, characterized in that said distributor rotates in a cylinder bore of a cylinder in synchronism with engine rpm, and wherein the functions for the control and for the fuel metering apparatuses are controlled via grooves and bores disposed in said jacket face and said cylinder, and further wherein the control fluid source is capable of being connected with at least one of said pump/nozzles at a time as well as the other of said pump/nozzles being connected with a relief line.

4. A fuel injection system as defined in claim 3, characterized in that said distributor further includes at least one axial groove and one annular groove by means of which said control lines which are disconnected from said control fluid source and which lead to said other pump/nozzles are uniformly relieved of pressure.

5. A fuel injection system as defined by claim 3, characterized in that independent fluid sources are provided to deliver the servo fluid, control fluid and the fuel to the respective control apparatus distributor device and fuel metering apparatus.

6. A fuel injection system as defined by claim 5, characterized in that said servo fluid serves to actuate said switch-over valve with the pressure of said servo fluid being reduced to the pressure of said control fluid before the control fluid flows through said distributor.

7. A fuel injection system as defined by claim 1, characterized in that a fuel supply pump is driven with said distributor, said pump further being utilized with said distributor and arranged to furnish at least the fuel for the said fuel metering apparatus.

8. A fuel injection system as defined by claim 1, characterized in that a central control unit comprises said annular slide, distributor and a housing and further wherein said distributor further includes a groove means arranged to open a discharge point of said control line, which determines the injection onset of the associated pump/nozzle.

9. A fuel injection system as defined by claim 1, characterized in that said distributor is guided in a bore of a housing of a central control unit, from which said control lines branch off, and further that said annular slide is disposed on an unguided portion of said distributor in a chamber filled with said control fluid.

10. A fuel injection system as defined by claim 1, characterized in that said annular slide is rotatable by an adjusting piston, which is urged counter to a restoring force, by a fluid whose pressure is controlled in accordance with rpm.

* * * * *